US007716842B2

(12) United States Patent
Sumner-Trivisani et al.

(10) Patent No.: US 7,716,842 B2
(45) Date of Patent: May 18, 2010

(54) CLIP-ON UTENSILS AND METHODS OF USE THEREOF

(76) Inventors: Carla Sumner-Trivisani, 31 Magnolia Rd., Hewitt, NJ (US) 07421; Scott Trivisani, 31 Magnolia Rd., Hewitt, NJ (US) 07421

( * ) Notice: Subject to any disclaimer, the term of this patent is extended or adjusted under 35 U.S.C. 154(b) by 173 days.

(21) Appl. No.: 11/520,393

(22) Filed: Sep. 13, 2006

(65) Prior Publication Data

US 2007/0006470 A1 Jan. 11, 2007

Related U.S. Application Data

(63) Continuation-in-part of application No. 10/938,212, filed on Sep. 10, 2004, now abandoned.

(51) Int. Cl.

| | |
|---|---|
| ***B25F 3/00*** | (2006.01) |
| ***B26B 3/00*** | (2006.01) |
| ***A47J 43/28*** | (2006.01) |
| ***B25G 3/32*** | (2006.01) |
| ***A47J 45/07*** | (2006.01) |
| ***A45F 5/00*** | (2006.01) |
| ***B26B 1/00*** | (2006.01) |
| ***B26B 11/00*** | (2006.01) |

(52) U.S. Cl. ..... 30/324; 30/327; 30/142; 30/322; 16/422; 16/425; 224/269

(58) Field of Classification Search ..... 30/123, 30/142, 143, 324, 327; 16/422, 425; 224/269
See application file for complete search history.

(56) References Cited

U.S. PATENT DOCUMENTS

| | | | | |
|---|---|---|---|---|
| 790,191 | A * | 5/1905 | Cowart | 30/327 |
| 1,393,574 | A | 10/1921 | Rohmiller | |
| 1,836,014 | A * | 12/1931 | Chamberlain | 30/327 |
| 2,021,619 | A * | 11/1935 | Waters et al. | 24/532 |
| 2,287,703 | A * | 6/1942 | Nyberg et al. | 30/123 |
| 2,341,121 | A * | 2/1944 | Schaaff | 24/561 |
| D156,370 | S | 12/1949 | Randall | |
| 2,682,705 | A * | 7/1954 | Johnson | 30/324 |
| 2,795,043 | A * | 6/1957 | Fleischer | 30/123.3 |
| 2,918,203 | A | 12/1959 | Hodgson | |
| 3,348,272 | A * | 10/1967 | Germani | 24/563 |
| 3,400,591 | A * | 9/1968 | Larson | 73/426 |
| 3,911,578 | A | 10/1975 | Ushkow et al. | |
| 3,931,668 | A | 1/1976 | Hombach | |

(Continued)

FOREIGN PATENT DOCUMENTS

| | | |
|---|---|---|
| JP | 2002-186549 | 7/2002 |

*Primary Examiner*—Boyer D Ashley
*Assistant Examiner*—Bharat C Patel
(74) *Attorney, Agent, or Firm*—Williamson Intellectual Property Law, LLC; Thomas R. Williamson, III

(57) ABSTRACT

Clip-on utensils and methods of use therefor, wherein the handle end of the utensil incorporates a clip for securing the utensil to the edge of a plate, bowl, glass or cup. The clip portion of the utensil is opened and subsequently positioned over the tableware edge, wherein the clip is subsequently released; thereby, gripping the edge of the tableware and securing the utensil thereon. When at rest, the clip portion forms a planar combination with the handle thereby imparting strength to the combination over that of the handle alone. Various alternative clipping means are described.

13 Claims, 6 Drawing Sheets

U.S. PATENT DOCUMENTS 4,020,532 A * 5/1977 Lichter ..... 24/562
4,121,798 A 10/1978 Schumacher et al.
4,231,128 A 11/1980 James
4,524,512 A * 6/1985 Formo et al. ..... 30/147
4,789,064 A 12/1988 Segal
4,863,033 A 9/1989 Buj
5,005,711 A 4/1991 Peatross et al.
5,014,434 A * 5/1991 Skerker et al. ..... 30/345
5,065,977 A * 11/1991 Desjardin ..... 248/692
D332,220 S * 1/1993 Specht et al. ..... D9/434
5,518,211 A 5/1996 Gaskill et al.
5,621,950 A * 4/1997 White ..... 24/67.5
5,699,614 A 12/1997 Gameau, Sr.
5,704,129 A 1/1998 Glesser
5,730,405 A 3/1998 Nichols, IV
5,823,483 A 10/1998 Gaskill
5,845,403 A 12/1998 Nivin
6,030,012 A * 2/2000 Hadj-Chikh et al. ..... 294/7
6,115,921 A 9/2000 Gameau, Sr.
6,213,517 B1 * 4/2001 Goluszka et al. ..... 281/45
D447,691 S 9/2001 Messer
6,421,921 B1 7/2002 Gameau, Sr.
D465,525 S * 11/2002 Dilday ..... D19/65
D487,682 S 3/2004 Hsien
6,808,095 B2 * 10/2004 Hurtgam ..... 224/251
6,851,574 B1 2/2005 Traynor
2003/0070299 A1 4/2003 Frazer
2006/0053638 A1 3/2006 Sumner-Trivisani

* cited by examiner

CLIP-ON UTENSILS AND METHODS OF USE THEREOF

PRIORITY CLAIM

To the fullest extent permitted by law, the present continuation-in-part application claims priority to and the benefit of U.S. Non-provisional Patent Application entitled CLIP-ON UTENSILS AND METHODS OF USE THEREFOR, filed on Sep. 10, 2004, now abandoned having Ser. No. 10/938,212, and of patent cooperation treaty application entitled CLIP-ON UTENSILS AND METHODS OF USE THEREFOR, filed on Sep. 8, 2005 having serial number PCT/US2005/031889.

TECHNICAL FIELD

The present invention relates generally to eating utensils, and more specifically to clip-on utensils and methods of use therefor, providing disposable eating utensils having an integral device for attachment of the utensils to other tableware, such as flatware and/or hollowware; thereby reducing encumbrance of the user by having to securely hold the utensils while retrieving or transporting food.

BACKGROUND OF THE INVENTION

It is often necessary for a diner to carry their plate and utensils while obtaining food from a central location, and then transport the acquired food back to a seating area. Such is often the case at buffets or picnics, where food plates and utensils are typically disposable. In addition to carrying a plate and utensils, the diner will typically require a napkin.

Accordingly, it often becomes difficult to hold a plate, utensils and/or napkin, while at the same time serving oneself from platters of food. It is therefore desirable to have some device and method to facilitate handling and transporting of acquired food, so as to free at least one hand for alternate use.

There are devices such as that of Peatross et al. (U.S. Pat. No. 5,005,711) that are utilized to support utensils. However, the Peatross et al. '711 device retains the utensil in holes on the side of a basket, or within external slots on the basket, and is, as such, not suited for application to disposable plate/utensil combinations.

Other devices, such as that of Nivin (U.S. Pat. No. 5,845,403), are suited for attachment of utensils together via a nesting facility located on the utensils themselves. However, the device of Nivin '403 lacks any means for attachment to a plate.

The knife of Glesser (U.S. Pat. No. 5,704,129) has a retaining clip incorporated therein; however, such a knife is not particularly suited as an eating utensil, and the clip is designed for retaining the knife within a pocket or upon a belt of the user. Moreover, the clip is an added component, beyond that required as a knife, that inconveniently requires assembly to the knife.

Buj (U.S. Pat. No. 4,863,033) teaches a set of children's eating utensils, such as spoons or spoon/fork combinations ('sporks') that have holes therein in order to fit the utensil over a peg on a plate, so as to retain the utensil thereon. However, while well suited for storage of the utensils in such a fashion, the utensils would obstruct the filling of such a plate while acquiring food from a buffet, wherein the pegs would obstruct the user during food consumption.

Hombach (U.S. Pat. No. 3,931,668) teaches a separate holding device for retention of utensils on cooking implements or on a bowl, wherein the holding device is attached via a clothespin or similar clipping device to retain the utensil in position on the bowl's edge. While the device of Hombach '668 may be suited for retention of utensils in such a fashion, it requires components that must be assembled prior to use, thus significantly reducing the expeditious and convenient use and application of same.

Therefore, it is readily apparent that there is a need for clip-on utensils and methods of use therefor, so as to secure eating utensils, and/or napkin, to a plate, (or bowl, cup or glass); thus enabling the person/diner acquiring food to separately carry the plate, utensils, and/or napkin in one hand, while placing food on the plate and/or carrying other objects with the free hand.

BRIEF SUMMARY OF THE INVENTION

Briefly described, in a preferred embodiment, the present invention overcomes the above-mentioned disadvantages and meets the recognized need for such a device by providing clip-on utensils and methods of use therefor, wherein the eating utensils have a clip integrally-formed therewith that facilitates the securing of the utensil on the edge of a plate, bowl, cup or glass.

According to its major aspects and broadly stated, the present invention in its preferred form is a variety of clip-on utensils and methods of use therefor, wherein the utensils have an integrally-formed securing clip, or the like, for securing to the edge of a plate, bowl or cup. The present invention further includes an optional napkin holder facility incorporated into the utensil, whereby a napkin is carried by the utensil while the utensil is secured to, and carried by, the plate, bowl, cup or glass.

More specifically, the present invention comprises clip-on utensils and methods of use therefor, wherein the handle end of the utensil incorporates a clip means for securing the utensil to the edge of a plate, bowl or cup. In the preferred embodiment, the clip is at approximately the mid-point of the handle and operates by pushing on a protuberance incorporated into the clip, which thereby opens the clip. The clip portion of the utensil is subsequently positioned over the tableware edge, and the clip is released; thereby, gripping the edge of the tableware and securing the utensil thereon. Various alternative clipping means are described.

Additionally, the structure of the clip permits nesting of several utensils together to provide compact storage and also prevents scattering and/or loss of the utensils. The utensil may include a napkin holder, such as, for exemplary purposes only, a hole through the handle or a clipping means within the handle adapted to removably secure or grasp a napkin therein.

In an alternate embodiment, the utensil has a handle, a base, a gripping member, a button, an aperture within the handle, a tip and an operative portion comprising a fork, knife, spoon or spork. The operative portion comprises a first surface and the tip comprises a second surface, wherein the first surface directionally restricts motion of the gripping member when the first surface is in contact with second surface. Gripping member can be moved out of the aperture in one direction only via pressure against button, wherein the tip of the gripping member is thereby moved away from the handle to permit insertion of the utensil over the edge of a piece of tableware. When pressure against the button is relaxed, the gripping member springingly returns into, but not through, the aperture, wherein contact is made between the first surface and the second surface, thereby preventing continuing movement of the gripping member through to theo other side of the aperture. Thus, when the gripping member is within the aperture, the gripping member and the handle form a solid surface that provides rigidity to the utensil, when same is utilized for eating. Weight of food or pressure of the utensil against an object pushes handle against gripping member, and the strengthened combination formed provides improved support over that which the handle alone can provide.

Accordingly, a feature and advantage of the present invention is its ability to permit a diner to carry utensils via securing same to other items of tableware, such as, for exemplary purposes only, plates, bowls, cups and/or glasses. Alternatively, the diner could secure the utensils to an article of clothing, or similar.

Another feature and advantage of the present invention is its ability to secure an eating utensil, or set of eating utensils, namely a knife, fork, and spoon, on an item of tableware.

Still another feature and advantage of the present invention is its ability to eliminate the need to separately carry utensils when transporting food on or in an item of tableware.

Yet another feature and advantage of the present invention is its ability to secure a napkin for transport.

Yet still another feature and advantage of the present invention is its ability to retain a napkin together with eating utensils, namely, a knife, fork and/or spoon.

A further feature and advantage of the present invention is its ability to nest utensils, and provide the consequent low volume occupied by the utensils when nested together.

An additional feature and advantage of the present invention is its ability to be retained securely upon a piece of tableware until subsequently removed for use.

Yet a further feature and advantage of the present invention is that it provides for a stronger utensil in use, while still permitting the utensil to be clipped over a piece of tableware.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

Figure 1A:
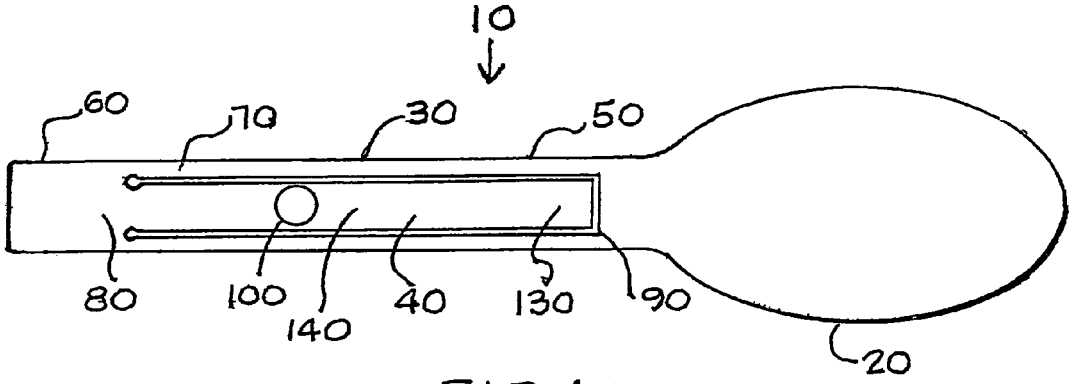
FIG. 1A is a top view of a clip-on utensil according to a preferred embodiment of the present invention.

In describing the preferred and selected alternate embodiments of the present invention, as illustrated in FIGS. 1-9B, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1A-3, the present invention in a preferred embodiment is utensil 10, wherein utensil 10 preferably comprises food handling member 20 disposed on handle 30, and wherein utensil 10 further preferably comprises gripping member 40.

Handle 30 preferably comprises first end 50, second end 60 and middle 70. Food handling member 20 is preferably in communication with first end 50, and gripping member 40 is preferably in communication with middle 70.

Figure 1B:
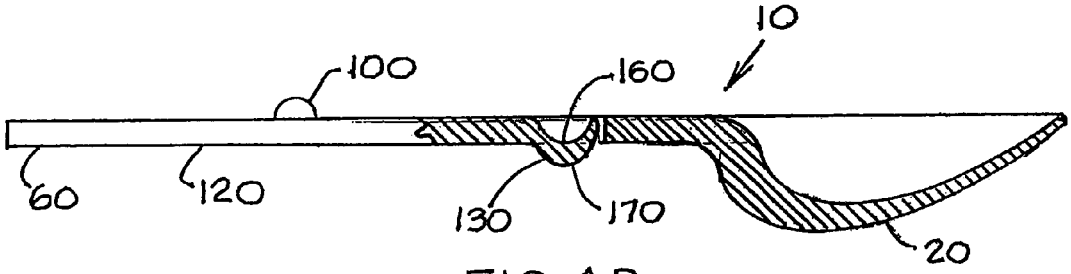
FIG. 1B is a side partial cross-sectional view of a clip-on utensil according to a preferred embodiment of the present invention, prior to operation of the clipping portion thereof.
Figure 1C:
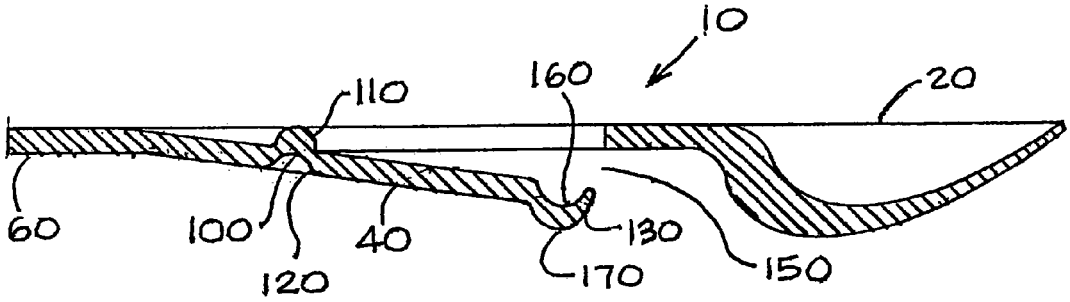
FIG. 1C is a side partial cross-sectional view of a clip-on utensil according to a preferred embodiment of the present invention, after opening of the clipping portion thereof.
Figure 1D:
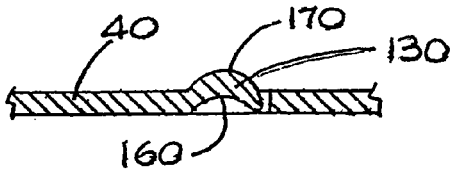
FIG. 1D is a partial side cross-sectional view of a reverse clipping portion of a clip-on utensil according to a preferred embodiment of the present invention.
Figure 2:
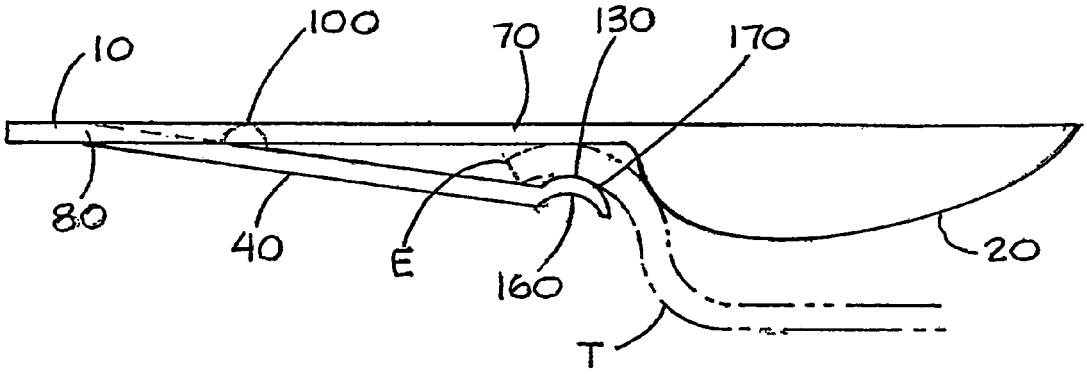
FIG. 2 is a side view of a clip-on utensil according to a preferred embodiment of the present invention, shown in use and secured to tableware.
Figure 3:
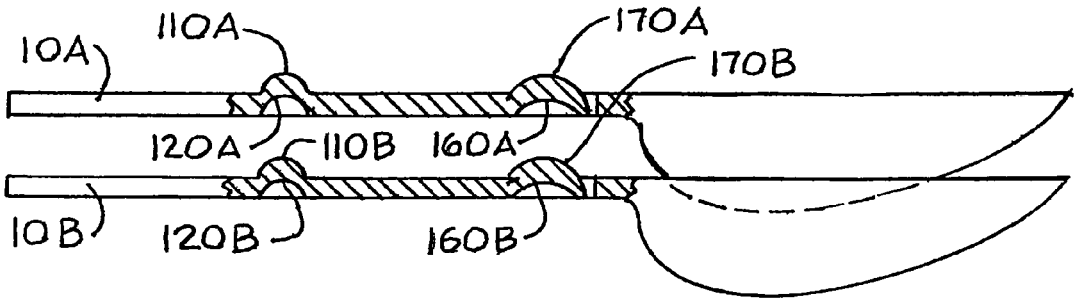
FIG. 3 is a side partial cross-sectional view of several clip-on utensils according to a preferred embodiment of the present invention, shown nesting together.

Gripping member 40 is preferably disposed on handle 30 of utensil 10, wherein gripping member 40 preferably comprises push button 100, flexible member 140 and grip 130. Grip 30 is preferably either as shown in FIGS. 1B and 1C, or reversed as shown in FIGS. 1D, 2 and 3, wherein the configuration is selected according to the configuration of edge E of tableware T. Grip 130 preferably lies in aperture 90, wherein aperture 90 preferably permits movement of gripping member 40 therethrough and therewithin.

Attachment point 80 of flexible member 140 is preferably carried proximate second end 60 of handle 30, wherein flexible member 140 is preferably contained within aperture 90 in handle 30. Attachment point 80 preferably provides flexibility, permitting grip 130 of gripping member 40 to be moved out of the plane of middle 70. Upon moving out of the plane of middle 70, gripping member 40 preferably creates gap 150, wherein gap 150 preferably receives edge E of tableware T. Upon release of gripping member 40, gripping member 40 preferably tends to its original position, approximately coplanar with middle 70, thereby causing grip 130 to retain any article placed therebetween.

In operation, after obtaining a utensil, diner D preferably depresses push button 100, thereby causing flexible member 140 to move apart and open gripping member 40. Gripping member 40 is preferably subsequently placed over the edge of tableware T and pressure on push button 100 is preferably relaxed, whereby gripping member 40 attempts to return to its original position, thereby preferably firmly gripping tableware T, and securing utensil 10 to tableware T.

Push button 100 preferably is round and has first side 110 and second side 120, wherein push button 100 is preferably convex-shaped on first side 110 and concave-shaped on second side 120 thereof, and wherein first side 110 and second side 120 of two different units of utensil 10 are preferably complementary, and, thus, may be cooperatively engaged. It will be recognized by those skilled in the art that first side 110 could be concave and second side 120 could be convex, without departing from the present invention.

Grip 130 preferably comprises first side 160 and second side 170, wherein first side 160 is preferably concave and second side 170 is preferably convex, and wherein second side 170 and first side 160 of two different units of utensil 10 are preferably complementary, and, thus, may be cooperatively engaged. Grip 130 could be any shape suitable to grip tableware T. It will be recognized by those skilled in the art that first side 160 could be convex and second side 170 could be concave to facilitate gripping of different-shaped tableware T, without departing from the present invention.

Referring now more specifically to FIG. 3, placement of utensils 10A and 10B together preferably results in convex side 110B of utensil 10B resting proximate concave side 120A of utensil 10A. Further, second side 170A of utensil 10A preferably rests proximate first side 160B of utensil 10B. Positioning of utensils 10B and 10B together preferably prevents lateral movement thereof, thereby securing utensils 10A and 10B together.

Figure 4:
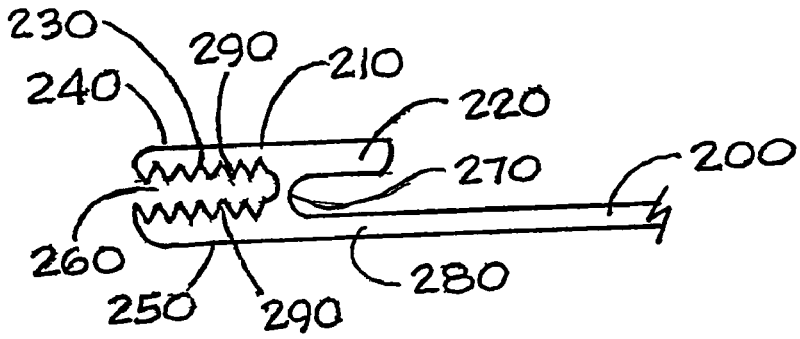
FIG. 4 is a side view of a gripping member portion of a clip-on utensil according to an alternate embodiment of the present invention.

Referring now more specifically to FIG. 4, illustrated therein is an alternate embodiment of utensil 10, wherein the alternate embodiment of FIG. 4 is substantially equivalent in form and function to that of the preferred embodiment detailed and illustrated in FIGS. 1-3 except as hereinafter specifically referenced. Specifically, the embodiment of FIG. 4 comprises utensil 200, wherein utensil 200 comprises serrated-jaw clip 210, and handle end 280. Serrated-jaw clip 210 has lever 220, grip 230, and pivot point 270. Grip 230 comprises upper jaw 240 and lower jaw 250, wherein upper jaw 240 and lower jaw 250 comprise gripping teeth 290, and wherein upper jaw 240 and lower jaw 250 form opening 260 therebetween upon manual separation. Specifically, pressing lever 220 towards handle end 280 causes jaws 240 and 250 to separate and form opening 260. Upon release of lever 220, jaws 240 and 250 tend to their approximate original position and removably grip anything placed therebetween, such as, for exemplary purposes only, tableware T. It will be recognized by those in the art that clip 210 could comprise non-serrated jaws without departing from the spirit of the present invention. It is further contemplated that clip 210, in a serrated or non-serrated jaw design, could comprise rubber foam or other suitable frictional substrate coated over jaws 240, 250, so as to enable retention of utensil 200 on glass or other low-frictional surface tableware.

Figure 5:
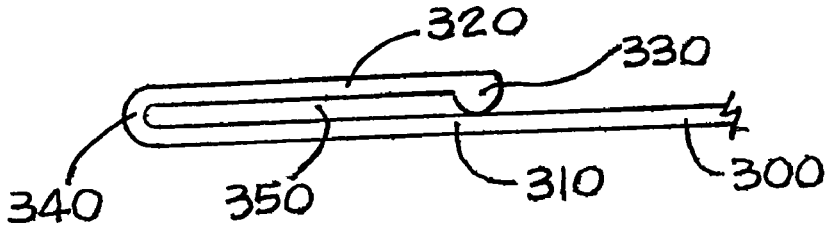
FIG. 5 is a side view of a clip member portion of a clip-on utensil according to an alternate embodiment of the present invention.

Referring now more specifically to FIG. 5, illustrated therein is an alternate embodiment of utensil 10, wherein the alternate embodiment of FIG. 5 is substantially equivalent in form and function to that of the preferred embodiment detailed and illustrated in FIGS. 1-3 except as hereinafter specifically referenced. Specifically, the embodiment of FIG. 5 comprises utensil 300, wherein utensil 300 comprises handle end 310, pen clip 320, protuberance 330 and pivot point 340. Pulling pen clip 320 away from handle end 310 results in opening of gap 350, whereby any article placed into gap 350 will be removably secured to utensil 300 by protuberance 330 upon relaxation of pen clip 320.

Figure 6A:
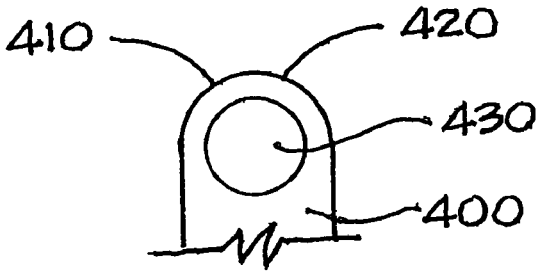
FIG. 6A is a top view of a napkin-holding portion of a clip-on utensil according to an alternate embodiment of the present invention.

Referring now more specifically to FIG. 6A, illustrated therein is an alternate embodiment of utensil 10, wherein the alternate embodiment of FIG. 6A is substantially equivalent in form and function to that of the preferred embodiment detailed and illustrated in FIGS. 1-3 except as hereinafter specifically referenced. Specifically, the embodiment of FIG. 6A comprises utensil 10, wherein utensil 10 comprises handle 410. Handle 410 has aperture 430 formed through handle end 420 thereof, Wherein insertion of a napkin into aperture 430 results in retention of the napkin by utensil 400.

Figure 6B:
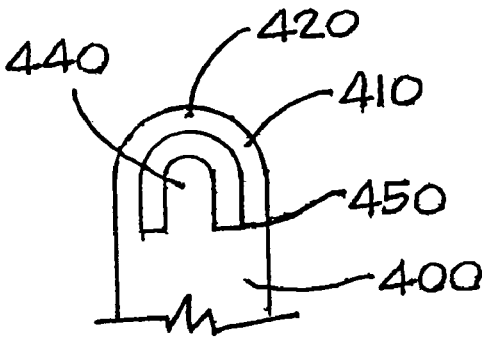
FIG. 6B is a top view of a napkin-holding portion of a clip-on utensil according to an alternate embodiment of the present invention.

FIG. 6B depicts a further alternate embodiment of utensil 10, wherein an alternate means is utilized to secure a napkin to utensil 10. Replacing aperture 430 of FIG. 6A, is gap 450, comprising tab 440 disposed proximate thereto. Insertion of a napkin through gap 450, or under tab 440, results in retention of the napkin by utensil 400.

Figure 7A:
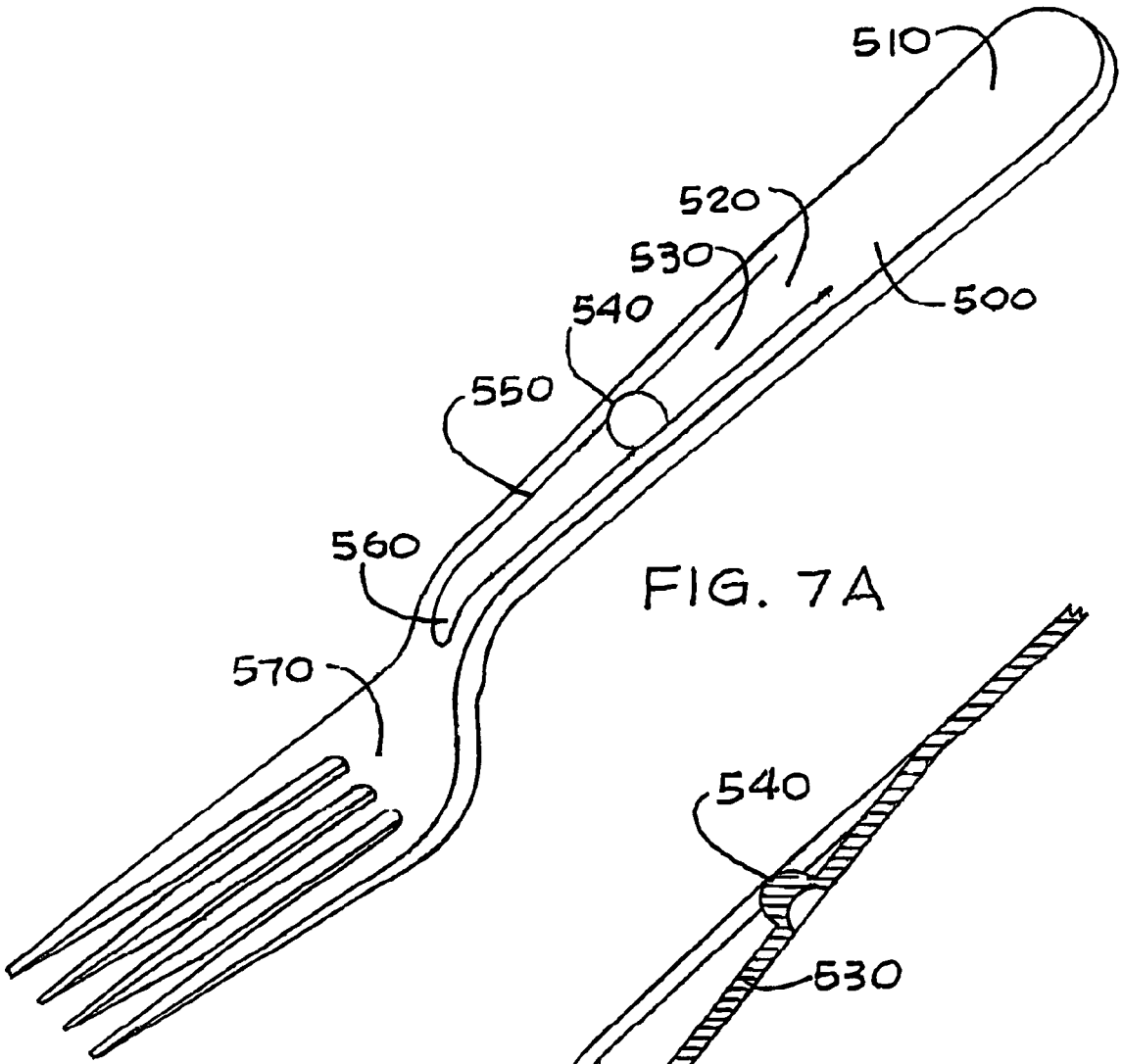
FIG. 7A is a perspective view of a fork clip-on utensil according to an alternate embodiment of the present invention.
Figure 7B:
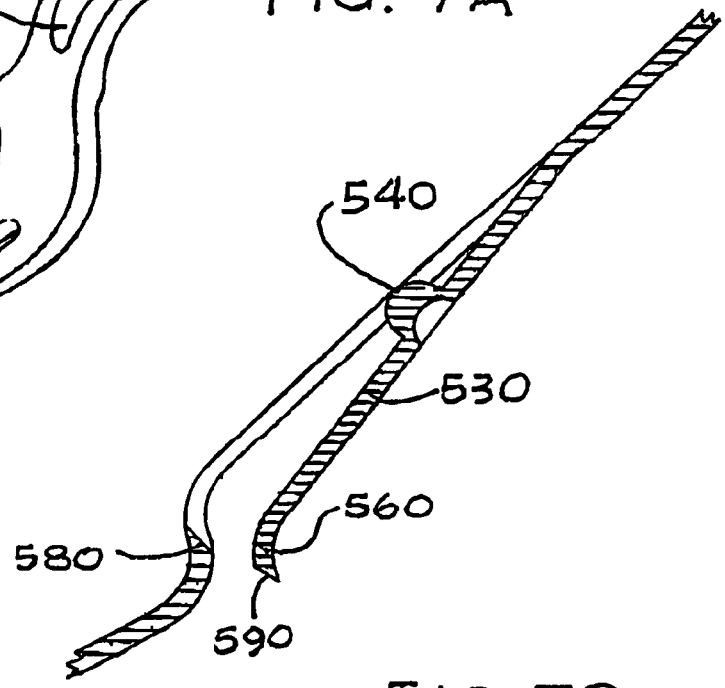
FIG. 7B is a detail cross-sectional view of a clip portion of a fork clip-on utensil according to an alternate embodiment of the present invention.

Referring now more specifically to FIGS. 7A-7B, illustrated therein is an alternate embodiment of utensil 10, wherein the alternate embodiment of FIGS. 7A-7B is substantially equivalent in form and function to that of the preferred embodiment detailed and illustrated in FIGS. 1-3 except as hereinafter specifically referenced. Specifically, the embodiment of FIGS. 7A-7B comprises utensil 500, wherein utensil 500 comprises handle 510, base 520, gripping member 530, button 540, aperture 550, tip 560 and fork 570. Handle 510 further comprises first surface 580 and tip 560 further comprises second surface 590, wherein first surface 580 directionally restricts motion of gripping member 530 when first surface 580 is in contact with second surface 590. Thus, gripping member 530 can be moved out of aperture 550 upon pressure against button 540, wherein tip 560 of gripping member 530 is moved away from handle 510 to permit insertion of utensil 500 over edge E of tableware T (as similarly shown for utensil 10 in FIG. 2). When pressure against button 540 is relaxed, gripping member 530 springingly returns into, but not through, aperture 550, wherein contact between first surface 580 and second surface 590 impedes continued movement of gripping member 530 through aperture 550 past said first surface 580. Thus, gripping member 530 and handle 510 form a solid surface that provides rigidity to utensil 500, when same is utilized for eating, wherein pressure exerted by weight of food on fork 570 pushes handle 510 against gripping member 530, and wherein first surface 580 and second surface 590 are in contact, and wherein the strengthened combination formed provides improved support over that which handle 510 alone can provide.

Figure 8A:
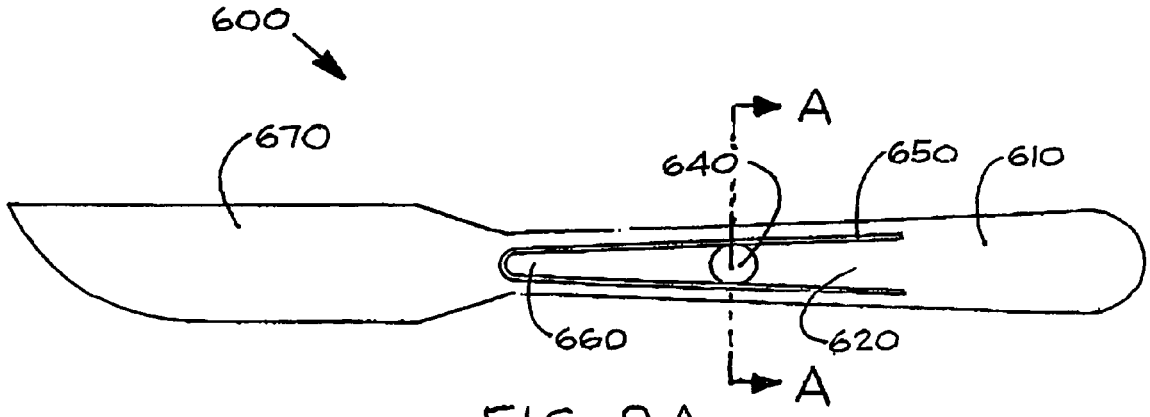
FIG. 8A is a top view of a knife clip-on utensil according to an alternate embodiment of the present invention.
Figure 8B:
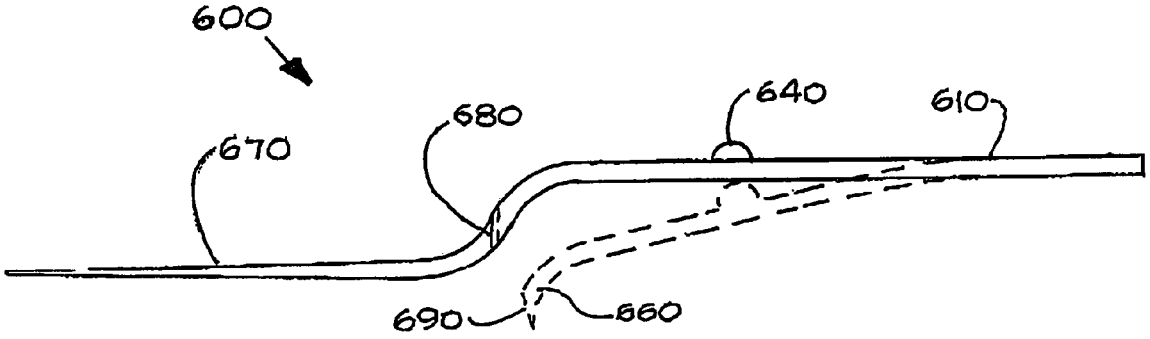
FIG. 8B is a side view of a knife clip-on utensil according to an alternate embodiment of the present invention.
Figure 8C:
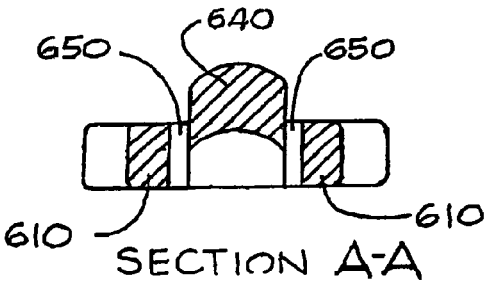
FIG. 8C is a cross-sectional view of a knife clip-on utensil according to an alternate embodiment of the present invention, taken through section A-A of FIG. 8A.

Referring now more specifically to FIGS. 8A-8C, illustrated therein is an alternate embodiment of utensil 10, wherein the alternate embodiment of FIGS. 8A-8C is substantially equivalent in form and function to that of the preferred embodiment detailed and illustrated in FIGS. 1-3 except as hereinafter specifically referenced. Specifically, the embodiment of FIGS. 8A-8C comprises utensil 600, wherein utensil 600 comprises handle 610, base 620, gripping member 630, button 640, aperture 650, tip 660 and knife blade 670. Handle 610 further comprises first surface 680 and tip 660 further comprises second surface 690, wherein first surface 680 directionally restricts motion of gripping member 630 when first surface 680 is in contact with second surface 690. Thus, gripping member 630 can be moved out of aperture 650 upon pressure against button 640, wherein tip 660 of gripping member 630 is moved away from handle 610 to permit insertion of utensil 600 over edge E of tableware T (as similarly shown for utensil 10 in FIG. 2). When pressure against button 640 is relaxed, gripping member 630 springingly returns into, but not through, aperture 650, wherein contact between first surface 680 and second surface 690 impedes continued movement of gripping member 630 through aperture 650 past said first surface 680. Thus, gripping member 630 and handle 610 form a solid surface that provides rigidity to utensil 600, when same is utilized for actions such as buttering bread, wherein pressure exerted by force of knife blade 670 pushes handle 610 against gripping member 630, wherein first surface 680 and second surface 690 are in contact, and wherein the strengthened combination formed provides improved support over that which handle 610 alone can provide.

Figure 9A:
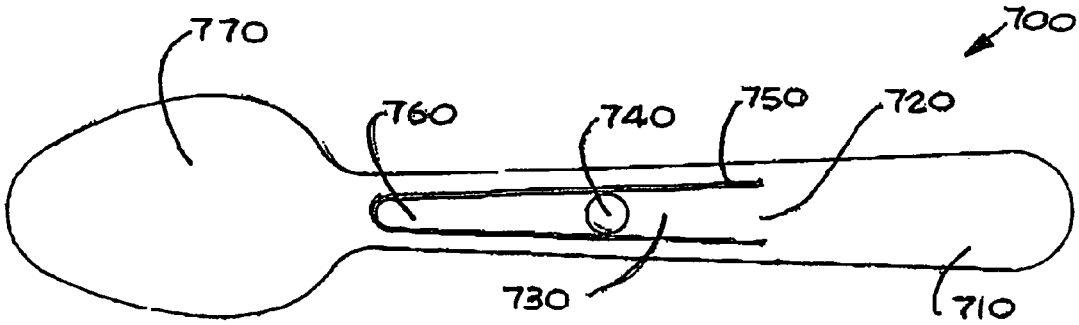
FIG. 9A is a top view of a spoon clip-on utensil according to an alternate embodiment of the present invention.
Figure 9B:
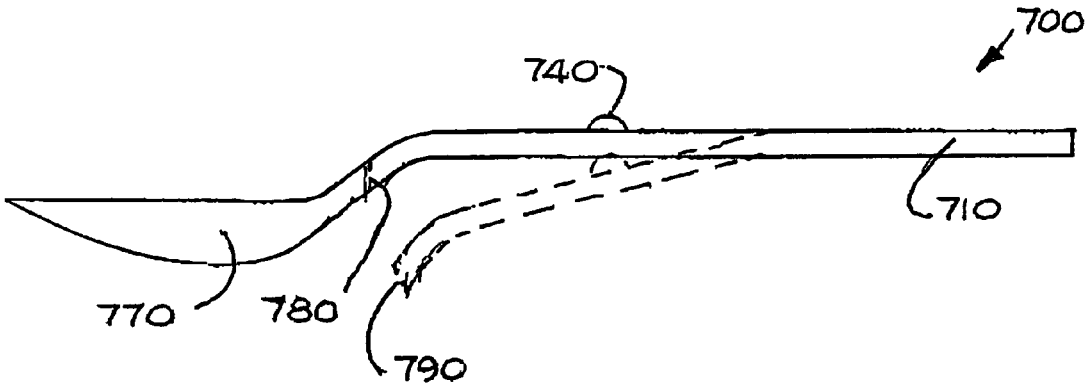
FIG. 9B is a side view of a spoon clip-on utensil according to an alternate embodiment of the present invention.

Referring now more specifically to FIGS. 9A-9B, illustrated therein is an alternate embodiment of utensil 10, wherein the alternate embodiment of FIGS. 9A-9B is substantially equivalent in form and function to that of the preferred embodiment detailed and illustrated in FIGS. 1-3 except as hereinafter specifically referenced. Specifically, the embodiment of FIGS. 9A-9B comprises utensil 700, wherein utensil 700 comprises handle 710, base 720, gripping member 730, button 740, aperture 750, tip 760 and spoon bowl 770. Handle 710 further comprises first surface 780 and tip 760 further comprises second surface 790, wherein first surface 780 directionally restricts motion of gripping member 730 when first surface 780 is in contact with second surface 790. Thus, gripping member 730 can be moved out of aperture 750 upon pressure against button 740, wherein tip 760 of gripping member 730 is moved away from handle 710 to permit insertion of utensil 700 over edge E of tableware T (as similarly shown for utensil 10 in FIG. 2). When pressure against button 740 is relaxed, gripping member 730 springingly returns into, but not through, aperture 750, wherein contact between first surface 780 and second surface 790 impedes continued movement of gripping member 730 through aperture 750 past said first surface 780. Thus, gripping member 730 and handle 710 form a solid surface that provides rigidity to utensil 700, when same is utilized for lifting and/or containing food within spoon bowl 770, wherein pressure exerted by force of spoon bowl 770 pushes handle 710 against gripping member 730, and wherein first surface 780 and second surface 790 are in contact, and wherein the strengthened combination formed provides improved support over that which handle 710 alone can provide.

It is envisioned in an alternate embodiment of the present invention that the napkin could be retained by a clip, and that such a clip could be integrally-formed to the handle of a utensil.

It is envisioned in a further alternate embodiment of the present invention that other styles of utensils could comprise an integrally-formed clip, such as, for exemplary purposes only, spatulas, and/or chopsticks.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. An eating utensil comprising:

an integrally-formed first retaining member comprising a clip adapted to secure said eating utensil on a unit of tableware, and a push button means for opening said integrally-formed first retaining member, wherein said push button means for opening comprises a convex surface and a concave surface, wherein said eating utensil comprises a handle having therein an opening, and wherein said handle comprises a first surface and said integrally-formed first retaining member comprises a tip having a second surface that impedes travel of said second surface past said first surface upon contact of said second surface with said first surface, and wherein said impeded travel directionally restricts said tip from passing through said opening, and wherein said opening permits movement of said integrally-formed first retaining member therewithin, a means for nesting a plurality of eating utensils.

2. The eating utensil of claim 1, wherein said eating utensil comprises a food handling member.

3. The eating utensil of claim 2, wherein said integrally-formed first retaining member is carried by said handle.

4. The eating utensil of claim 1, wherein said eating utensil further comprises a second integrally-formed retaining member.

5. The eating utensil of claim 4, wherein said second integrally-formed retaining member comprises a means for retaining a napkin selected from the group consisting of loop members, clipping members and members comprising a gap and tab arrangement.

6. The eating utensil of claim 1, wherein said first retaining member and said handle comprise a plane when said first surface and said second surface are in contact with one another.

7. A method of transporting utensils, said method comprising the steps of:

obtaining at least one utensil having an integrally-formed retaining member comprising a clip, wherein said integrally-formed retaining member comprises a tip having a second surface, and a push button means for opening said integrally-formed first retaining member, wherein said push button means for opening comprises a convex surface and a concave surface, and wherein said at least one utensil comprises a handle having therein an opening, and wherein said handle comprises a first surface that impedes travel of said second surface past said first surface upon contact of said second surface with said first surface, and wherein said impeded travel directionally restricts said tip from passing through said opening, and wherein said opening permits movement of said integrally-formed clip therewithin, and wherein a plurality of said eating utensils comprises a means for nesting together; and placing said integrally-formed clip over the edge of a unit of tableware.

8. The method of claim 7, further comprising the steps of:

opening said integrally-formed clip; and releasing said integrally-formed clip, whereby said integrally-formed clip secures said at least one utensil to the unit of tableware.

9. The method of claim 8, wherein said integrally-formed clip comprises an opening member, and wherein said step of opening said integrally-formed clip further comprises the step of applying pressure to said opening member, whereby said clip is opened.

10. The method of claim 9, wherein said opening member comprises a round member, and wherein said at least one utensil comprises at least a second utensil having a second round member, and wherein said round member is adapted to receive and secure said second round member.

11. The method of claim 10, further comprising the step of nesting said at least one utensil and said at least a second utensil together.

12. The method of claim 7, wherein said at least one utensil further comprises a means for retaining a napkin.

13. A food transporting system comprising:

a unit of tableware; and a clip-on utensil, wherein said clip-on utensil comprises an integrally-formed securing member comprising a push button means for opening said integrally-formed first retaining member, wherein said push button means for opening comprises a convex surface and a concave surface, and wherein said clip-on utensil comprises a handle having therein an opening, and wherein said handle comprises a first surface and said integrally formed first securing member comprises a tip having a second surface that directionally impedes travel of said second surface past said first surface upon contact of said second surface with said first surface, and wherein said opening permits movement of said integrally-formed securing member therewithin, and wherein a plurality of said eating utensils comprises a means for nesting together.

* * * * *